United States Patent [19]

Buckner

[11] 4,154,217

[45] May 15, 1979

[54] FIREPLACE SCREEN

[75] Inventor: Carrol E. Buckner, Weaverville, N.C.

[73] Assignee: Buck Stove Marketing, Corporation, Asheville, N.C.

[21] Appl. No.: 828,786

[22] Filed: Aug. 29, 1977

[51] Int. Cl.[2] ..... F24C 15/02

[52] U.S. Cl. ..... 126/140; 126/202

[58] Field of Search ..... 126/138, 140, 202; 160/DIG. 9; D7/208

[56] References Cited

U.S. PATENT DOCUMENTS

| | | | |
|---|---|---|---|
| 588,146 | 8/1897 | Havecotte | 126/202 |
| 1,425,341 | 8/1922 | Sanders | 126/202 |
| 1,759,619 | 5/1930 | Hutchinson, Jr. | 126/202 |
| 4,010,730 | 3/1977 | Mitchell | 126/140 |

FOREIGN PATENT DOCUMENTS

| | | | |
|---|---|---|---|
| 748790 | 5/1956 | United Kingdom | 126/202 |
| 849598 | 9/1960 | United Kingdom | 126/202 |

*Primary Examiner*—John J. Camby
*Assistant Examiner*—Larry I. Schwartz
*Attorney, Agent, or Firm*—Leitner, Palan, Martin & Bernstein

[57] ABSTRACT

A screen having front, two side and bottom faces wherein the horizontal and vertical edges of the side faces form an angle greater than ninety degrees.

4 Claims, 3 Drawing Figures

FIREPLACE SCREEN

BACKGROUND OF THE INVENTION

The present invention relates generally to fireplace screens and more specifically to an improved fireplace screen.

Fireplace screens of the prior art generally include front and two side portions that are placed on a hearth in front of the fireplace to cover the fireplace opening to prevent ashes, soot, and other items from being projected from the fireplace into the room in which the fireplace is located. Though being relatively stable for flying sparks and small bits of wood, the screens of the prior art have not been efficiently stable to prevent a large object, for example a burning log, from rolling from the fireplace knocking the screen over and rolling into the room causing a substantial fire hazard. Thus there exists a need for a screen for the fireplace which is not only capable of preventing small bits of material from leaving the fireplace and entering the room but also which is sufficiently stable to prevent burning logs leaving the fireplace from entering the room.

SUMMARY OF THE INVENTION

The fireplace screen of the present invention includes a front face, a bottom face, and two side faces. The side faces include a front edge, a back edge and a bottom edge. The front face is connected between the two front edges of the side faces and the bottom face is connected between the two bottom edges of the side faces. The back and bottom edges of the side faces form an angle greater than ninety degrees. This angle causes the fireplace screen, when placed with the bottom face on a substantial horizontal surface of a fireplace and the top edge of the front face touching the front of the fireplace, to rest in a substantially stable position. When a heavy object such as a log is placed or rolls upon the bottom face, the screen rotates toward the fireplace front, locking the top edge firmly against the fireplace. The screen is made up of front, bottom, and rear side frame members and a pair of horizontal frame members interconnecting the top and bottom edges of the rear frame members. A single piece of screening material is secured on the frame to form the front, bottom and side faces.

OBJECTS OF THE PRESENT INVENTION

An object of the present invention is to provide a more stable fireplace screen.

Another object of the invention is to provide a fireplace screen of simplified construction.

A further object of the invention is to provide a fireplace screen capable of withstanding and capturing a log rolling from the fireplace.

Still another object of the invention is to provide a fireplace screen which is designed to increase the locking of the fireplace screen to the front of the fireplace upon an object falling upon the bottom face of the screen.

Other objects, advantages, and novel features of the invention will become apparent from the following detailed description of the invention when considered in conjunction with the accompanying drawings.

DESCRIPTION OF THE PREFERRED EMBODIMENTS

Figure 1:
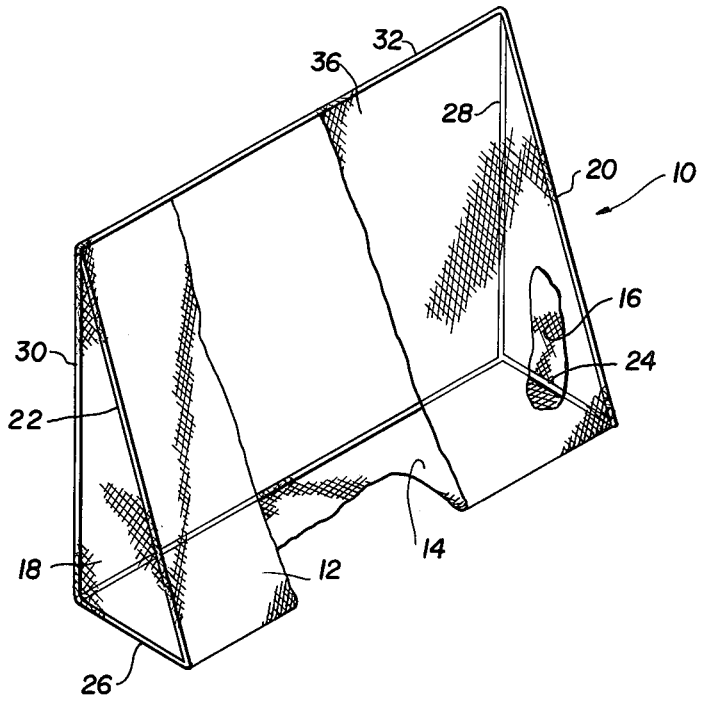
FIG. 1 is a perspective view of a fireplace screen incorporating the principles of the present invention.

FIG. 1 illustrates a preferred embodiment of the fireplace screen 10 having a front face 12, a bottom face 14, and a pair of side faces 16 and 18. The side faces include a front frame member 20 and 22, a bottom frame member 24 and 26, and rear frame members 28 and 30. A pair of horizontal frame members 32 and 34 interconnect the top and bottom of rear frame members 28 and 30 respectively. A single piece of screening material 36 is shown wrapped around the frame members so as to provide front face 12, bottom face 14, and side faces 16 and 18. The screening is secured by appropriate fasteners.

Although the screen is illustrated as including only eight frame members, it is obvious that additional strength could be provided by a third horizontal frame member connecting the bottom edges of front frame members 20 and 22. The screening material used is generally stiff enough to form a screen without the use of the third horizontal frame member. The use of a single sheet of screening material is desired since it involves fewer fasteners and is easier to manufacture. If desired, the individual faces may be made from separate and distinct pieces of screen material.

In addition to the specific construction described for the screen 10, the main importance is the ability of the screen to catch a log rolling from the fireplace and to hold the log therein. This ability is provided by making the angle formed by rear frame members 28, 30 and bottom frame members 24, 26 greater than ninety degrees.

Figure 2:
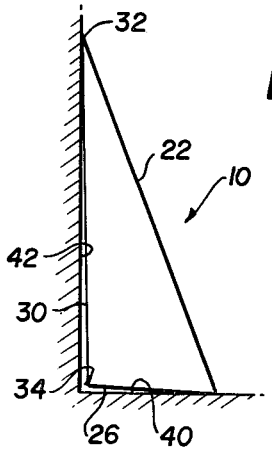
FIG. 2 is a side schematic representation of a fireplace screen placed on a fireplace hearth in an unloaded condition.

To illustrate the importance of this angle, the screen 10 is positioned on a fireplace having a substantially horizontal portion 40 and a substantially vertical portion 42. The horizontal portion 40 may be a hearth or platform extending from the front of a free-standing fireplace or stove and 42 is generally the front of the fireplace. The screen 10 is generally placed on the front with the top horizontal frame member 32 engaging the front 42 of the fireplace and the front edges of the bottom face 14 engaging the horizontal surface 40 of the fireplace. As illustrated in FIG. 2, the lower horizontal member 34 is spaced from the front of the fireplace 42 and from the horizontal surface 40. The drawing is greatly exaggerated to illustrate the principle of operation. A substantial portion of rear frame members 28, 30 engage surface 42 and a substantial portion of the bottom face 14 engages surface 40.

Figure 3:
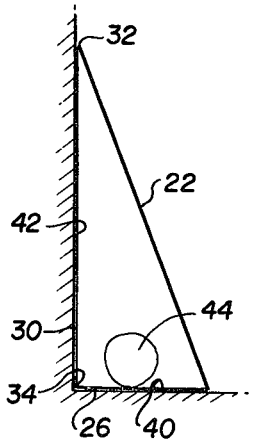
FIG. 3 is a side schematic representation of the fireplace screen positioned on a fireplace in the loaded condition.

When a log or any other heavy object rolls from the fireplace and engages or comes to rest on the bottom face 14 of the screen, the screen rotates towards the fireplace locking the top edge 32 tightly against the fireplace front 42. The bottom face 14 also rotates down towards the horizontal surface 40 increasing the amount or portion of face 14 which engages the face 40. As illustrated in FIG. 3, the bottom horizontal member 34 is closer to the vertical front of fireplace 42 as well as closer to the horizontal surface 40.

Although the placement of the screen 10 as shown in FIG. 2 is the preferred placement which allows the greatest rotation of the screen to further lock the screen to the fireplace when a log or other heavy object falls on to the bottom face 14, other placements may be made. For example, the fireplace screen may be efficiently spaced from the horizontal surface 42 such that the bottom face 14 completely touches the horizontal surface 40. This will eliminate the ability for the screen to rotate but still provide a screen stability which is capable of withstanding the weight of a log rolling against the front face 12 and coming to rest on the bottom face 14.

From the preceding description of the preferred embodiments, it is evident that the objects of the invention are attained and although the invention has been described and illustrated in detail, it is to be clearly understood that the same is by way of illustration and example only and is not to be taken by way of limitation. The spirit and scope of this invention is to be limited only by the terms of the appended claims.

What is claimed:

1. In the combination of a fireplace having a front surface and a horizontal surface adjacent to said front surface and a fireplace screen, the improvement being said fireplace screen comprising a front face, a bottom face connected to said front face, a pair of side faces each having a front edge, a back edge, and a bottom edge, said front face being connected between said front edges, said bottom face being connected between said bottom edges, said back and bottom edges being substantially vertical and horizontal respectively and form an angle between them sufficiently greater than ninety degrees to maintain the adjacent portions of said back and bottom edges spaced from said front surface and from said horizontal surface respectively when the top edge of said front face is appropriately positioned touching said front surface and the bottom edge of said front face is appropriately positioned touching said horizontal surface.

2. A fireplace screen for use in combination with a fireplace, said screen comprising a front face means having a top edge for engaging the front surface of a fireplace, a bottom face means for engaging a horizontal surface adjacent to the front surface of said fireplace, and two side face means interconnected by said front and bottom face means and being of a triangular configuration for facilitating rotation of said top edge toward said front surface when said top edge is positioned adjacent to said front surface and said bottom face means is positioned on said horizontal surface to maintain the rear edge of said bottom face means spaced from said front and horizontal surfaces and when a weight is subsequently placed on said bottom face means.

3. The fireplace screen according to claim 2 wherein said side face means each include a substantially vertical rear edge and a substantially horizontal bottom edge, and said rear and bottom edges form an angle sufficiently greater than ninety degrees to facilitate said rotation.

4. A fireplace screen comprising a pair of side frames each including a front, back, and bottom frame member interconnected in a triangle, a pair of horizontal frame members interconnecting the top and bottom of said rear frame members respectively and a single sheet of screening secured to said frame members to form front, two side, and bottom faces, said back frame members are substantially vertical and said bottom frame members are substantially horizontal and said back frame members form an angle with said bottom frame members significantly greater than ninety degrees.

* * * * *